United States Patent [19]

Eisele et al.

[11] 3,942,496

[45] Mar. 9, 1976

[54] FUEL INJECTION SYSTEM

[75] Inventors: Hermann Eisele, Nellingen; Gerhard Stumpp, Stuttgart, both of Germany

[73] Assignee: Robert Bosch GmbH, Stuttgart, Germany

[22] Filed: Sept. 23, 1974

[21] Appl. No.: 508,564

[30] Foreign Application Priority Data

Oct. 3, 1973 Germany ..... 2349631

[52] U.S. Cl. ..... 123/139 AW; 123/119 R

[51] Int. Cl.[2] ..... F02D 1/00

[58] Field of Search ..... 123/139 AW, 119 R

[56] References Cited

UNITED STATES PATENTS

| | | | |
|---|---|---|---|
| 3,703,888 | 11/1972 | Eckert et al. | 123/139 AW |
| 3,713,430 | 1/1973 | Knapp et al. | 123/139 AW |
| 3,739,758 | 6/1973 | Knapp et al. | 123/139 AW |
| 3,791,359 | 2/1974 | Eckert et al. | 123/139 AW |
| 3,809,036 | 5/1974 | Knapp et al. | 123/139 AW |
| 3,817,229 | 6/1974 | Stumpp | 123/97 B |
| 3,842,813 | 10/1974 | Eckert | 123/139 AW |
| 3,894,523 | 7/1975 | Stumpp | 123/139 AW |

*Primary Examiner*—Wendell E. Burns
*Assistant Examiner*—James W. Cranson, Jr.
*Attorney, Agent, or Firm*—Edwin E. Greigg

[57] ABSTRACT

A fuel injection system for externally ignited engines employing continuous manifold injection includes a fuel metering valve assembly. The control slide of this valve assembly is actuated by the air-flow through the induction manifold and controls the size of fuel flow apertures. A differential pressure valve normally maintains a constant pressure difference across these metering valve apertures. The magnitude of this normally constant pressure difference can be altered in response to signals obtained from or measurements performed on operational parameters of the engine; for example, the oxygen content of the engine's exhaust gases.

12 Claims, 3 Drawing Figures

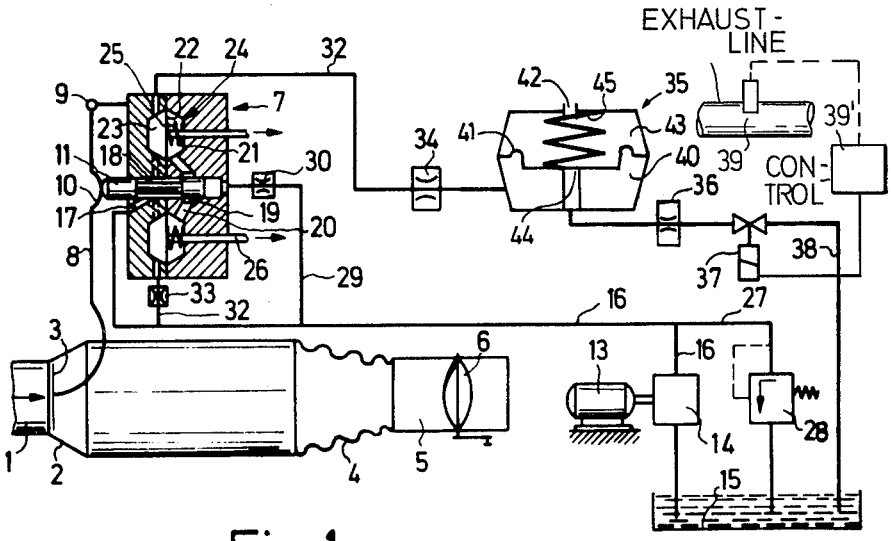
Fig. 1
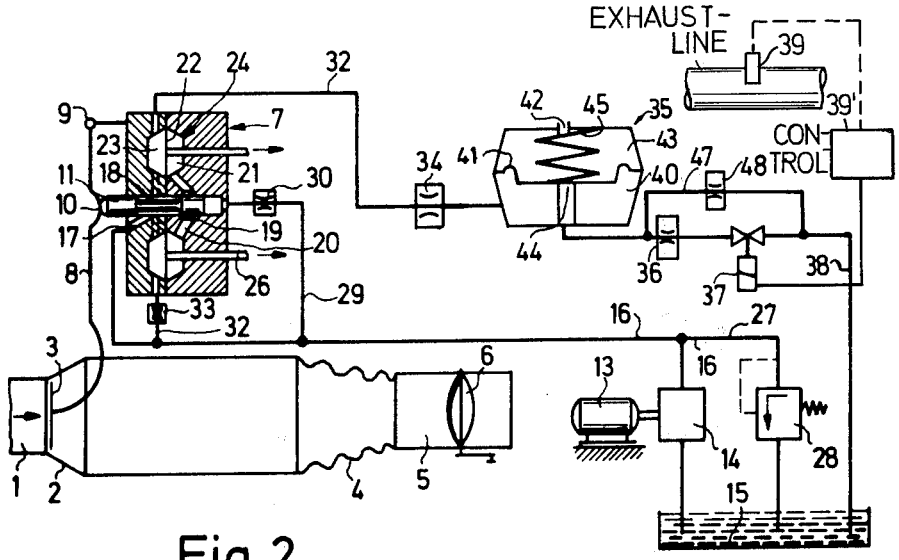
Fig. 2
Fig. 3
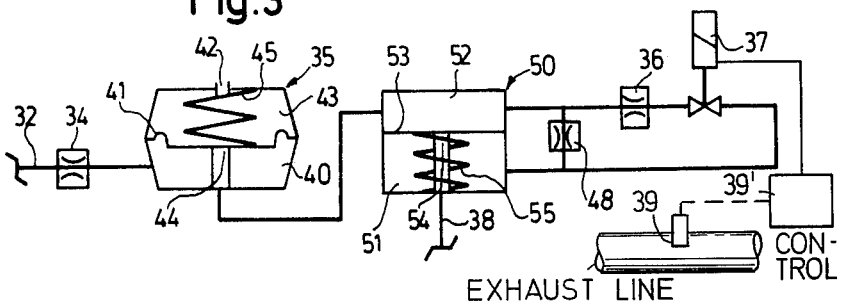

FUEL INJECTION SYSTEM

BACKGROUND OF THE INVENTION

The invention relates to a fuel injection system for mixture compressing, spark plug ignited internal combustion engines employing continuous injection into the induction manifold, in which an air-flow measuring element and an arbitrarily actuatable butterfly valve are disposed in series within the induction manifold. The air-flow measuring element is displaced corresponding to the air flow through the induction tube and against a resetting force. This displacement is transmitted to the movable member of a valve assembly disposed within the fuel line for the purpose of metering out a fuel quantity proportional to the air quantity. The fuel metering process occurs at a constant pressure difference across the valve assembly but the pressure difference may be changed in dependence on motor parameters.

Fuel injection systems of this type serve the purpose of automatically creating a favorable fuel-air mixture suitable for all operational conditions of the internal combustion engine so as to make possible a complete combustion of the fuel and thus to avoid the generation of toxic exhaust components while maintaining the highest possible performance of the internal combustion engine or the least possible fuel consumption. For this reason, the fuel quantity must be metered out very precisely according to the requirement of each operational state of the internal combustion engine and the proportionality between the air quantity and the fuel quantity must be changed in dependence on motor parameters. The laws and regulations affecting the exhaust gas constituents of vehicle engines are becoming more restrictive all the time and make necessary a very precise control of the optimum fuel quantity injected. Thus, for example, the catalyzers which are used, among other things, for exhaust gas detoxification require an air ratio equivalent to an air number $\lambda$ close to 1.0 in order to achieve the substantially complete transformation of detrimental exhaust components into harmless compounds. It is already known, in fuel injection systems of this type, to alter electromagnetically the pressure difference prevailing at the metering valve and by means of a differential pressure valve but this involves a relatively large constructional expense.

OBJECT AND SUMMARY OF THE INVENTION

It is an object of the invention to provide a fuel injection system of the above described kind which satisfies the above-cited requirements which are made on such a fuel injection system, at the lowest possible constructional expense.

This object is attained, according to the invention, by placing a first throttle between the fuel supply circuit of the fuel injection system and the control pressure circuit and by providing, downstream of this first throttle, one chamber of a differential pressure valve. It is further provided that the pressure difference prevailing at the metering valve aperture may be changed by modifying the pressure in the control pressure circuit. This is done by the cooperation of an electro-magnetic valve, a second throttle, a fuel storage unit and a third throttle.

A favorable feature of the invention includes connecting the second throttle, the storage unit, the third throttle and the magnetic valve in series within the control pressure circuit.

It is another favorable and advantageous feature of the invention that the differential pressure control valve is a flat seat valve which includes a diaphragm as its movable closure member, the diaphragm being biased in the opening direction by a spring.

In a particularly favorable arrangement, the differential pressue valve is constructed to act as an equal pressure valve, its movable element being a diaphragm.

Another advantageous feature of the invention provides that a fourth throttle is located in parallel with a series combination of the third throttle and the electromagnetic valve.

A further preferred feature of the invention provides that a pressure control valve is placed within the control pressure circuit, downstream of the storage unit, with the fourth throttle being parallel thereto and also in parallel with the series combination of the third throttle and the electro-magnetic valve.

It is another advantageous feature of the invention that the fourth throttle is located within a diaphragm which constitutes the movable closure member of the pressure control valve.

According to a preferred characteristic of the invention, the electro-magnetic valve is opened by a so-called oxygen sensor whenever the fuel-air mixture becomes leaner than a predetermined value and the valve is closed whenever the fuel-air mixture becomes richer than a certain predetermined value.

BRIEF DESCRIPTION OF THE DRAWING

The drawing represents three exemplary embodiments of the invention in simplified form; these embodiments will be described in detail below.

FIG. 1 is a diagram of a first exemplary embodiment of the fuel injection system according to the invention;

FIG. 2 is a diagram of a second exemplary embodiment of the fuel injection system including equal pressure — differential pressure valves.

FIG. 3 is a diagram of a third exemplary embodiment of a fuel injection system with equal pressure — differential pressure valves.

DESCRIPTION OF THE PREFERRED EMBODIMENTS

Turning now to the fuel injection system shown in FIG. 1, combustion air flows, in the direction indicated by an arrow, into an induction manifold 1 which has a conical region 2 enclosing an air-flow measuring element 3 and thence through a connecting conduit 4 and an induction tube region 5 which encloses an arbitrarily actuatable butterfly valve 6. The air continues to flow from the region 5 on to one or several cylinders (not shown) which form a part of an internal combustion engine. The air-flow measuring element 3 is embodied as a plate, disposed transverse with respect to the air flow. During operation, the measuring element 3 is displaced within the conical region 2 of the induction tube in accordance with an approximately linear function of the air quantity flowing through the induction tube. The pressure prevailing between the measuring element 3 and the butterfly valve 6 remains constant provided that the resetting force acting upon the measuring element 3 is constant and that the air pressure prevailing ahead of the measuring element 3 is also constant.

The air-flow measuring element 3 directly influences a metering and quantity distribution valve assembly 7. The movements of the measuring element 3 are transmitted by an attached lever 8 which pivots about a point 9 and during such pivotal movement a projection 10 provided thereon, as shown, actuates the movable valve element, embodied as a control slide 11, of the metering and quantity distribution valve assembly 7.

The fuel is delivered by a fuel pump 14, driven by an electric motor 13, from a fuel container 15 and flows through a line 16 and a channel 17 into an annular groove 18 provided in the control slide 11. Depending upon the position of the control slide 11, the annular groove 18 extends to a greater or lesser degree over control slots 19 each of which communicates, via channels 20, with respective chamber 21. Each of the chambers 21 is separated from a respective chamber 23 by a respective diaphragm 22. Each of the diaphragms 22 serves as the movable valve element of a flat-seat valve embodied as a differential pressure valve 24 and is loaded in the direction of opening of the valve by a spring 25.

From chamber 21, fuel flows through channels 26 to the individual injection valves (not shown), which are disposed within the induction tube in the vicinity of the engine cylinders.

Branching off from the line 16, is a line 27 which includes a pressure limiting valve 28 which permits the fuel to flow back into the fuel container 15 if the pressure in the system becomes too high.

The end-face of control slide 11 farthest from the lever 8 is actuated by pressurized fluid which serves as the resetting force for the air-flow measuring element 3 and which reaches the control slide through a line 29 containing a damping throttle 30.

Also branching off from the line 16 is a line 32 containing, in series, a first throttle 33, the chambers 23 of the differential pressure valve 24, a second throttle 34, a storage unit 35, a third throttle 36, and an electromagnetic valve 37. When the electromagnetic valve 37 is opened, fuel may flow out of the control pressure circuit 32 at zero gauge pressure through a return line 38 back to the fuel container 15. The storage unit 35 includes a storage chamber 40 which is separated by a diaphragm 41 from another chamber 43 that is open to atmospheric pressure through an opening 42. The storage chamber 40 contains a fixed valve seat 44 from which the diaphragm may be lifted by the control pressure in the storage chamber 40 and against the force of a spring 45.

The fuel injection system shown in FIG. 1 functions as follows:

When the internal combustion engine is running, air is aspirated through the induction tube 1, 4 and 5, causing a certain displacement of the air-flow measuring element 3 from its normal position. Corresponding to the displacement of the measuring element 3, the lever 8 displaces the control slide 11 of the metering and quantity distribution valve assembly 7 and the control slide 11 meters out fuel which flows to the individual injection valves. The direct connection between the measuring element 3 and the control slide 11 results in a constant ratio of the air quantity to the metered out fuel quantity, so long as the characteristic operating properties of the measuring element 3 and the slide 11 are sufficiently linear, which is a normally desired goal. In order to make the fuel-air mixture richer or leaner, depending on the domain of the operational region of the internal combustion engine involved, one must be able to make a change in the proportionality between the aspirated air quantity and the metered out fuel quantity and this must be possible in dependence on motor parameters. One such parameter may be, for example, the oxygen content in the exhaust gas, monitored by means of a so-called oxygen sensor 39 located in the exhaust line of the internal combustion engine. This sensor 39 may actuate the electromagnetic valve 37 through an electronic control circuit 39. The change of the fuel-air mixture can be made either by changing the resetting force at the measuring element 3 or else by changing the differential pressure prevailing at the metering valve apertures 18, 19. The differential pressure prevailing at the differential pressure valves 24 can be controlled and changed, preferably in unison, by the pressure in the control pressure circuit 32. For this purpose, the control pressure circuit 32 contains the first throttle 33, the chambers 23 of the differential pressure valves 24, the second throttle 34, the storage unit 35, the third throttle 36 and the magnetic valve 37, all in series. The electromagnetic valve 37 is opened by an oxygen sensor 39, acting through the electronic control circuit 39′ whenever the input voltage to the circuit falls below a certain threshold voltage indicating a particular concentration of oxygen within the exhaust gas or a particular leaned-out fuel-air mixture. When the electromagnetic valve 37 is open, fuel flows from the storage chamber 40 of the storage unit 35 over the fixed valve seat 44, the third throttle 36 and through the electromagnetic valve 37 back to the fuel container 15. The control pressure within the storage chamber 40 decreases, causing more fuel to flow through the first throttle 33 and the second throttle 34 corresponding to the greater pressure difference. As the control pressure falls in the chambers 23 of the differential pressure valve 24, the spring 25 opens the differential pressure valve 24 to a greater extent and a larger fuel quantity can flow from the chambers 21 through the channels 26 to the injection valves. This reduces the pressure in the chambers 21, increasing the pressure difference prevailing at the metering valve apertures 18, 19 resulting in an increased metered-out fuel quantity.

If, on the other hand, the voltage produced by the oxygen sensor 39 exceeds a certain threshold value representing a particular enriched fuel-air mixture, then the electromagnetic valve 37 is closed by the electronic control circuit 39′. The fuel flowing through the first throttle 33 and second throttle 34 now flows into the storage chamber 40, increasing the pressure in the control pressure circuit 32. The increase of pressure in the chambers 23 of the differential pressure valve 24 causes a reduction in the flow of fuel through the channels 26 to the injection valves and thus leads to a pressure increase in the chambers 21. As a result, the pressure difference prevailing at the metering valve apertures 18, 19 is decreased, causing a reduced fuel quantity to be metered out until such time as the oxygen sensor 39 again produces the signal for opening the electromagnetic valve 37. The minimum control pressure which the storage unit 35, when closed, maintains in the control pressure circuit 32 is so chosen that no vapor bubbles are produced during any of the operational conditions of the internal combustion engine. In order to insure that, at the operating point of the regulator, the same rate of change in the metered out fuel quantity is obtained during increasing and decreasing injection quantity, the three throttles 33, 34 and 36 are so chosen that when a particular control pressure prevails in the storage chamber 40 and while the electromagnetic valve 37 is open, the fuel quantity flowing through the throttle 36 is twice as large as that flowing through the throttles 33 and 34. When the minimum permissible control pressure in the storage chamber 40 is reached, the diaphragm 41 interrupts the fuel return through the fixed valve seat 44 which limits the maximum fuel quantity metered out at the metering valve apertures 18, 19. When the magnetic valve 37 is closed, the minimum fuel quantity metered out at the metering valve apertures 18, 19 is obtained when the pressure in the control pressure circuit 32 is equal to the system pressure in the line 16. In that case, the injection quantity is determined by the compression of the springs 25 in the differential pressure valves 24.

In the second exemplary embodiment of the invention, according to FIG. 2, the differential pressure valves 24 are embodied as equal pressure valves, i.e., the differential pressure valves are not biased in the opening direction by a supplementary spring loading. This has the advantage that, when the metering and quantity distribution valve is assembled, a precisely tuned adjustment of the individual springs is unnecessary. The minimum metered out fuel quantity may be limited, in this second exemplary embodiment, in that the third throttle 36 and the electromagnetic valve 37 are permanently bypassed by a line 47 containing a fourth throttle 48. In that case, the control pressure in the storage chamber 40 always stays below that of the main fuel system pressure by an amount depending on the dimension of the fourth throttle 48.

The third exemplary embodiment of the invention is depicted in FIG. 3. This figure only shows that part of the control pressure circuit 32 which lies downstream of the chambers 23 of the differential pressure valves 24 in the fuel injection system according to FIG. 2. In FIG. 3, parts which are identical to those of FIGS. 1 and 2 retain the same reference numerals. The third exemplary embodiment, according to FIG. 3, offers the advantage that the minimum fuel quantity which is metered out is independent of the main fuel system pressure in the line 16, not shown in FIG. 3. To this end, the first throttle 33 and the second throttle 34 are traversed by a calibrated flow-rate determined by a fourth throttle 48 across which a pressure control valve 50 maintains a constant pressure difference. The fourth throttle 48 and the pressure control valve 50 are connected in parallel in the pressure control circuit 32. The pressure control valve 50 is embodied as a flat seat valve which contains a chamber 51, separated from a chamber 52 by a diaphragm 53 that serves as the movable valve member. The chamber 51 contains a fixed valve seat 54 and a spring 55 which biases the valve in the direction of opening. The fourth throttle 48 can be disposed within the diaphragm 53 and may connect the chambers 51 and 52 of the pressure control valve 50. The change of the flow-rate through the first throttle 33 and the second throttle 34 is obtained by placing a third throttle 36 in parallel with the pressure control valve 50 and the fourth throttle 48 and by putting the magnetic valve 37 in series with the third throttle 36. When the pressure control valve 50 is opened, fuel may flow over the fixed valve seat 54 and through the return line 38 back to the fuel container 15.

It is to be appreciated that the foregoing descriptions and accompanying figures in the drawing relate to illustrative embodiments of an improved fuel injection system given by way of example, not by way of limitation. Numerous variants and other embodiments are possible within the spirit and scope of the invention, the scope being defined in the appended claims.

What is claimed is:

1. In a fuel injection system for mixture compressing, externally ignited combustion engines employing continuous injection of fuel into an induction manifold within which are disposed, in series, an air-flow measuring element and an arbitrarily actuatable butterfly valve and where an air-flow measuring element is displaced by and in relation to air-flow, against a resetting force, and thereby moves a movable part of a fuel metering valve assembly including fuel metering valve apertures associated with each engine cylinder, wherein the metering valve assembly meters out fuel in proportion to air quantity while a constant pressure difference prevails at the metering valve apertures, and where the magnitude of the pressure difference may be altered in dependence on motor parameters, the improvement comprising:

a. a first throttle, connected to a fuel supply line;
b. a fuel control pressure circuit, positioned downstream of said first throttle;
c. at least one differential pressure valve, one chamber of which is located in said fuel control pressure circuit downstream of said first throttle;
d. a second throttle, located in said control pressure circuit, downstream of said chamber of said differential pressure valve;
e. a fuel storage unit, located in said fuel control pressure circuit, downstream of said second throttle;
f. a third throttle, located in said fuel control pressure circuit, downstream of said fuel storage unit; and
g. an electromagnetic valve, located in said fuel control pressure circuit, downstream of said third throttle;

whereby the cooperation of the electromagnetic valve, the third throttle, the fuel storage unit and the second throttle may change the fuel pressure in part of the differential pressure valve thereby changing the pressure difference prevailing at the fuel metering valve apertures.

2. An improved fuel injection system as defined in claim 1, wherein said second throttle, said fuel storage unit, said third throttle and said electromagnetic valve are disposed in series connection in said fuel control pressure circuit.

3. An improved fuel injection system as defined in claim 2, further including a fourth throttle, located in said fuel control pressure circuit in parallel connection to the series combination of said third throttle and said electromagnetic valve.

4. An improved fuel injection system as defined in claim 3, further including a pressure control valve, located in said fuel control pressure circuit, and connected in parallel with said fourth throttle and with the series combination of said third throttle and said electromagnetic valve.

5. An improved fuel injection system as defined in claim 4, wherein said fourth throttle is located within a movable closure element of said pressure control valve, said movable closure element being embodied as a diaphragm.

6. An improved fuel injection system as defined in claim 1, wherein said differential pressure valve is a flat-seat valve having a diaphragm as its movable closure member, and including a spring for biasing said valve in its opening direction.

7. An improved fuel injection system as defined in claim 1, wherein said differential pressure valve is an equal pressure valve having a diaphragm as its movable closure member.

8. An improved fuel injection system as defined in claim 7 further including a fourth throttle, located in said fuel control pressure circuit, in parallel connection with the series combination of said third throttle and said electromagnetic valve.

9. An improved fuel injection system as defined in claim 8, further including a pressure control valve, located in said fuel control pressure circuit and connected in parallel with said fourth throttle and with the series combination of said third throttle and said electromagnetic valve.

10. An improved fuel injection system as defined in claim 9, wherein said fourth throttle is located within a movable closure element of said pressure control valve, said movable closure element being emobodied as a diaphragm.

11. An improved fuel injection system as defined in claim 1, further including an oxygen sensor means which causes said electromagnetic valve to open when the fuel-air mixture is leaner than a predetermined ratio.

12. An improved fuel injection system as defined in claim 1, further including an oxygen sensor which causes said electromagnetic valve to close when the fuel-air mixture is richer than a predetermined ratio.

* * * * *